US008400072B2

(12) United States Patent
Huang et al.

(10) Patent No.: US 8,400,072 B2
(45) Date of Patent: Mar. 19, 2013

(54) LIGHT EMITTING DEVICE DRIVER CIRCUIT DRIVING LIGHT EMITTING DEVICE BY POSITIVE AND NEGATIVE VOLTAGES AND METHOD FOR DRIVING LIGHT EMITTING DEVICE BY POSITIVE AND NEGATIVE VOLTAGES

(75) Inventors: Pei-Cheng Huang, Jhubei (TW); Jing-Meng Liu, Zhubei (TW); Roland Van Roy, Eindhoven (NL)

(73) Assignee: Richtek Technology Corporation, R.O.C., Hsin-Chu (TW)

( * ) Notice: Subject to any disclaimer, the term of this patent is extended or adjusted under 35 U.S.C. 154(b) by 269 days.

(21) Appl. No.: 12/942,179

(22) Filed: Nov. 9, 2010

(65) Prior Publication Data

US 2011/0133657 A1 Jun. 9, 2011

Related U.S. Application Data

(60) Provisional application No. 61/267,915, filed on Dec. 9, 2009.

(51) Int. Cl.

| | |
|---|---|
| ***H05B 41/16*** | (2006.01) |
| ***H05B 41/24*** | (2006.01) |
| *H05B 37/00* | (2006.01) |
| *H05B 39/00* | (2006.01) |
| *H05B 41/00* | (2006.01) |
| *H05B 37/02* | (2006.01) |
| *H05B 39/04* | (2006.01) |
| *G05F 1/00* | (2006.01) |

(52) U.S. Cl. ..... 315/254; 315/186; 315/219; 315/279; 315/291; 315/312

(58) Field of Classification Search ..... None
See application file for complete search history.

(56) References Cited

U.S. PATENT DOCUMENTS

| | | | | |
|---|---|---|---|---|
| 2004/0032754 | A1* | 2/2004 | Yang | 363/56.09 |
| 2008/0084167 | A1* | 4/2008 | Waffenschmidt et al. | 315/210 |

* cited by examiner

*Primary Examiner* — Douglas W Owens
*Assistant Examiner* — Dedei K Hammond
(74) *Attorney, Agent, or Firm* — Tung & Associates

(57) ABSTRACT

The present invention discloses a light emitting device driver circuit and a method for driving a light emitting device. In the present invention, the secondary windings of a transformer provide positive and negative secondary voltages, so as to generate positive and negative output voltages. A light emitting device circuit is coupled between the positive and negative output voltages. As such, the specification to withstand high voltage for a device in the circuit is reduced.

11 Claims, 2 Drawing Sheets

LIGHT EMITTING DEVICE DRIVER CIRCUIT DRIVING LIGHT EMITTING DEVICE BY POSITIVE AND NEGATIVE VOLTAGES AND METHOD FOR DRIVING LIGHT EMITTING DEVICE BY POSITIVE AND NEGATIVE VOLTAGES

CROSS REFERENCE

The present invention claims priority to U.S. provisional application 61/267,915, filed on Dec. 9, 2009.

BACKGROUND OF THE INVENTION

1. Field of Invention

The present invention relates to a light emitting device driver circuit and a method for driving a light emitting device; particularly, it relates to a light emitting device driver circuit and a method for driving a light emitting device, which require less number of circuit devices and the circuit devices can be made of devices of lower voltage sustaining specification.

2. Description of Related Art

Referring to FIG. 1, conventionally, to provide power to a light emitting device circuit from an AC power supply, it requires an AC-DC power regulator 10 to convert an AC voltage to a DC voltage, and a light emitting device driver circuit 20 to provide electrical power to the light emitting device circuit 50 and control current through the light emitting devices. The AC-DC power regulator 10 comprises a transformer 13, a primary side circuit 11, and a secondary side circuit 12. The secondary side circuit 12 detects the output voltage DC OUT, and provides a feedback signal to a pulse width modulation (PWM) controller PWM in the primary side circuit 11 by means of opto-coupling, to control the operation of a power switch P in the primary side circuit 11.

The aforementioned prior art has the following drawbacks. Because it requires the AC-DC power regulator 10 to generate a regulated voltage and the light emitting device driver circuit 20 to control current through the light emitting device circuit 50 according to the regulated voltage, the prior art circuitry needs at least three integrated circuit (IC) chips: the primary side circuit 11, the secondary side circuit 12, and the light emitting device driver circuit 20; this is not cost-effective. Besides, when the light emitting device circuit 50 requires high DC output voltage, the devices in the secondary side circuit 12, in the light emitting device driver circuit 20, and in the light emitting device circuit 50 which may possibly contact the high DC output voltage should be made of devices capable of sustaining such high voltage. Therefore, both the number of the circuit devices and the high voltage sustaining specification result in higher cost.

In view of the above, it is desired to provide a light emitting device driver circuit and a method for driving a light emitting device without these drawbacks.

SUMMARY OF THE INVENTION

The first objective of the present invention is to provide a light emitting device driver circuit, which for example can be applied to driving a light emitting diode (LED) circuit.

The second objective of the present invention is to provide a method for driving a light emitting device.

To achieve the objectives mentioned above, from one perspective, the present invention provides a light emitting device driver circuit, comprising: a primary side circuit for receiving AC power and generating a primary voltage; a transformer coupled to the primary side circuit, the transformer including a primary winding and a secondary winding, for converting the primary voltage to a secondary voltage; and a secondary side circuit coupled to the transformer, the secondary side circuit generating an output voltage according to the secondary voltage, and providing an output current to a light emitting device circuit; wherein the secondary winding has a first winding and a second winding, and the first and second windings provide a positive voltage and a negative voltage respectively, the positive and negative voltages together forming the secondary voltage, and wherein the output voltage includes a positive output voltage and a negative output voltage, and the light emitting device circuit is coupled between the positive and negative output voltages.

In one embodiment, the driver circuit preferably includes a current detection circuit for detecting the output current and generating the current detection signal.

In the aforementioned driver circuit, the secondary side circuit preferably includes an operational amplifier which generates an operation signal according to a current detection signal related to the output current; and wherein the driver circuit further includes an opto-coupling circuit for generating a feedback signal according to the operation signal by opto-coupling, the feedback signal being fed back 2to the primary side circuit.

In the aforementioned driver circuit, the primary side circuit preferably includes a power switch coupled to the primary winding, and a PWM control circuit which switches the power switch according to the feedback signal to control the conduction time of the primary winding, to thereby adjust an average of the output current.

In one of the preferred embodiments, the light emitting device circuit includes at least one light emitting device string which has multiple light emitting devices connected in series, and a current detection circuit coupled in the light emitting device string, wherein there is at least one light emitting device located at each of two sides of the current detection circuit.

In one of the preferred embodiments, the light emitting device circuit includes at least one light emitting device string which has multiple light emitting devices connected in series, and a transistor switch coupled in the light emitting device string, wherein there is at least one light emitting device located at each of two sides of the transistor switch; and wherein the secondary side circuit includes a PWM dimming control circuit, which generates a dimming signal for controlling the transistor switch to adjust the average of the output current, wherein the light emitting device circuit further includes two resistors which are coupled to the two sides of the transistor switch respectively.

From another perspective, the present invention provides a method for driving a light emitting device, comprising: receiving AC power and generating a primary voltage according to the AC power; providing a transformer for converting the primary voltage to a secondary voltage, wherein the secondary voltage includes a positive voltage and a negative voltage; converting the secondary voltage to a positive output voltage and a negative output voltage; and providing a light emitting device circuit coupled between the positive and negative output voltages.

In the aforementioned method, the transformer preferably includes a primary winding and a secondary winding, and the method for driving a light emitting device further includes: detecting current through the light emitting device circuit; and feedback controlling the conduction time of the primary winding according to the detection result.

The aforementioned method may further include: controlling the conduction time of the primary winding by pulse width modulation, such that an average current through the light emitting device circuit is lower than a maximum current.

The aforementioned method may further include: controlling the conduction time of the light emitting device circuit by pulse width modulation, such that an average current through the light emitting device circuit is lower than a maximum current.

The objectives, technical details, features, and effects of the present invention will be better understood with regard to the detailed description of the embodiments below.

DESCRIPTION OF THE PREFERRED EMBODIMENTS

Figure 2:
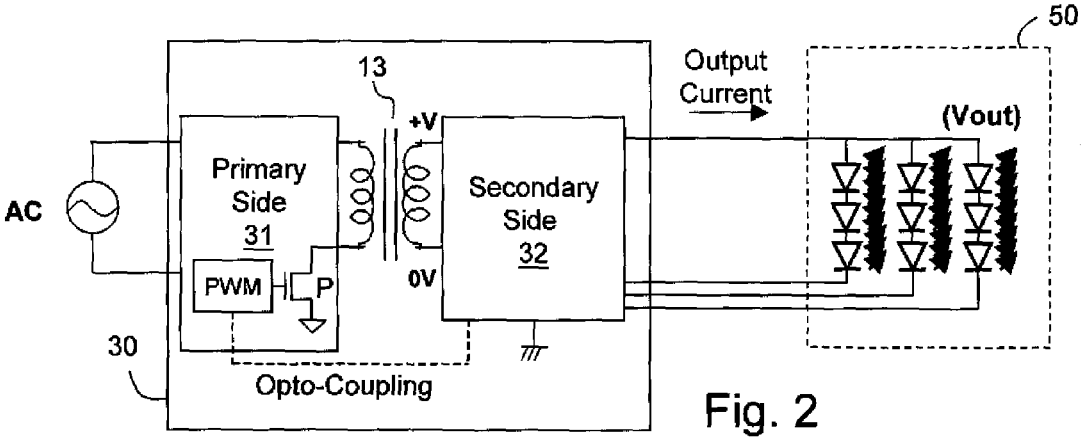
FIG. 2 shows a first embodiment of the present invention.

As shown in FIG. 2, the present invention does not require two-stage conversion as in the prior art, i.e., first converting the AC voltage to the DC voltage, and next converting the DC voltage to the current supplied the light emitting device circuit 50; instead, the present invention directly converts the AC voltage to a regulated output current by a primary side circuit 31, a transformer 13, and a secondary side circuit 32 in a light emitting device driver circuit 30, and supplies the regulated output current to the light emitting device circuit 50. The present invention does not need the two IC chips of the secondary side circuit 12 and the driver circuit 20. The output current for example can be regulated by feeding back a signal related to the output current to the primary side circuit 31, for example by opto-coupling, and controlling the operation of a power switch P according to the signal.

Figure 3:
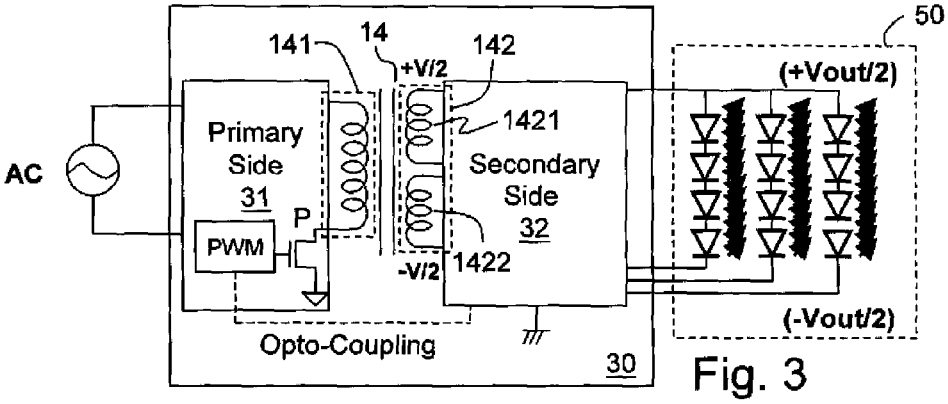
FIG. 3 shows another embodiment of the present invention.

FIG. 3 shows another embodiment of the present invention. As shown in the figure, the light emitting device driver circuit 30 of this embodiment includes: the primary side circuit 31 for receiving AC power and generating a primary voltage; a transformer 14 coupled to the primary side circuit 31, the transformer 14 including a primary winding 141 and a secondary winding 142, for converting the primary voltage to a secondary voltage; and a secondary side circuit 32 coupled to the transformer 14, the secondary side circuit 32 generating an output voltage according to the secondary voltage, and providing an output current to the light emitting device circuit 50. The light emitting device circuit 50 for example is an LED circuit, but it can be any other current-controlled circuit (not necessarily a circuit emitting light). In this embodiment, the secondary winding 142 has a first winding 1421 and a second winding 1422. The first and second windings 1421 and 1422 provide a positive voltage +V/2 and a negative voltage −V/2 respectively. The positive and negative voltages +V/2 and −V/2 together form the secondary voltage, which has one end of +V/2 and the other end of −V/2. The secondary voltage is converted to a positive output voltage +Vout/2 and a negative output voltage −Vout/2 by the secondary side circuit 32. Therefore, the devices in the secondary side circuit 32 does not need to sustain the total voltage V of the secondary voltage or the total output voltage Vout, but only have to sustain half of the total voltage V/2 or Vout/2; thus, the devices can be made of lower voltage sustaining specification, such that the cost of the circuitry is reduced, and the life of the circuitry is extended.

Figure 4:
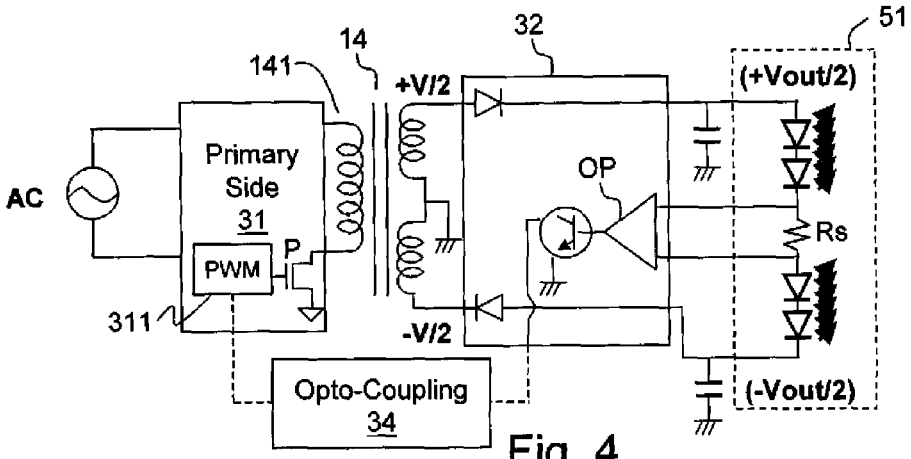
FIG. 4 shows yet another embodiment of the present invention.

FIG. 4 shows another embodiment of the present invention. In this embodiment, the light emitting device circuit 51 further includes a resistor Rs, as a current detection circuit, for detecting the output current. The resistor Rs is connected to the light emitting devices in series, and the resistor Rs is at about middle location of the light emitting device string. The wording "about middle location of the light emitting device string" means that: the resistor Rs does not directly contact the positive or negative output voltage +Vout/2 or −Vout/2; there is at least one light emitting device connected with the resistor Rs at each end. In a preferred embodiment, the numbers of the light emitting devices at both ends of the resistor Rs are equal. But the scope of the present invention should cover the condition that the numbers of the light emitting devices at both ends of the resistor Rs are not equal. The voltage difference across the resistor Rs is the current detection signal. The current detection signal is inputted to an operational amplifier OP in the secondary side circuit 32. The operational amplifier OP generates an operation signal according to the current detection signal. This operation signal is amplified by a transistor, and an opto-coupling circuit (Opto-coupler) 34 generates a feedback signal according to the amplified signal. The feedback signal is sent to a pulse width modulation (PWM) controller, PWM 311, in the primary side circuit 31. Thus, by switching the power switch P to control the conduction time of the primary winding 141, the current through the light emitting device circuit 51 can be controlled so that regulated current is provided to the light emitting device circuit 51 for lighting.

Still referring FIG. 4, because one end of the light emitting device string is positive and the other end is negative, the resistor Rs is preferably located at about middle of the light emitting device string. The advantages of such arrangement are that: the voltage sustaining specification of the resistor Rs can be lower, and compared to coupling the resistor Rs at one end of the light emitting device string, a more accurate current detection signal can be generated in the embodiment of FIG. 4, to control the brightness more correctly.

In the embodiment of FIG. 4, the current through the light emitting device circuit 51 not only can be controlled at a fixed constant value (usually corresponding to the maximum brightness), but also can be controlled by pulse width modulation to adjust the brightness of the light emitting device circuit 51, i.e., to provide a dimming function.

Figure 1:
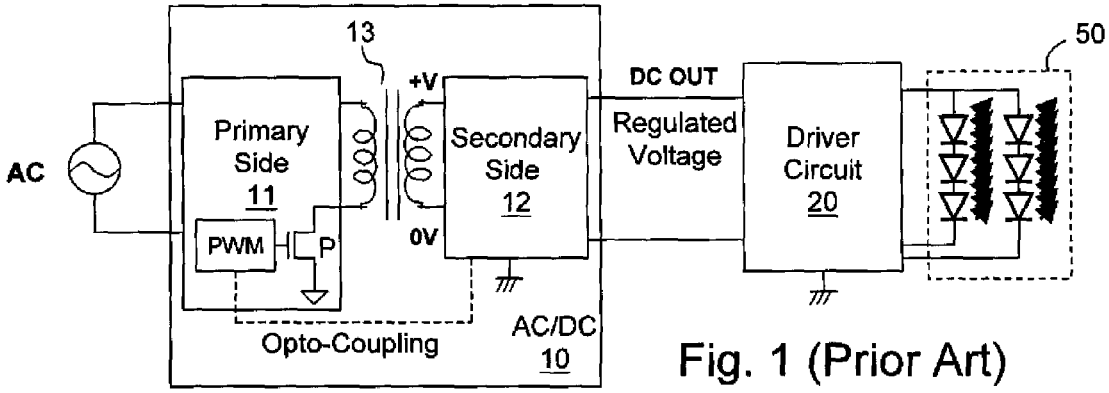
Fig. 1 (Prior Art)
FIG. 1 shows a prior art circuitry which includes an AC-DC power regulator 10 for converting an AC voltage to a DC voltage, and an LED driver circuit 20 which provides electrical power to an LED circuit 50.
Figure 5A:
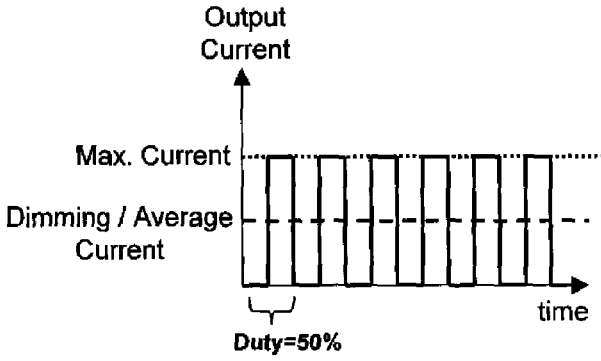
FIGS. 5A and 5B show an example as to how to adjust the average brightness of the light emitting device circuit 51.
Figure 5B:
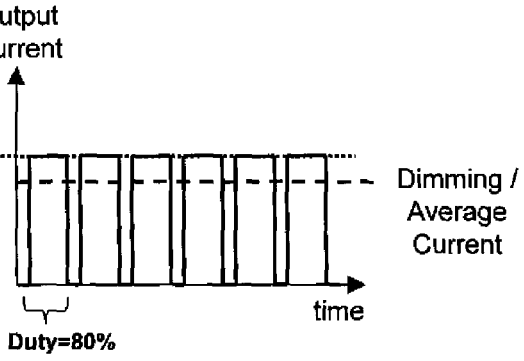

FIGS. 5A and 5B explain how the brightness of the light emitting device circuit 51 is controlled by way of pulse width modulation. Let us assume that when the duty ratio of the PWM signal controlling the power switch P is 100% (corresponding to the conduction time of the primary winding 141), the output current supplied to the light emitting device circuit 51 is the maximum current. As shown in FIG. 5A, if the duty ratio of the power switch P maintains at 50%, the average of the output current (the dimming/average current shown in the figure) is 50% of the maximum current; i.e., the brightness of the light emitting device circuit 51 is about half the brightness when the duty ratio is 100%. Similarly, as shown in FIG. 5B, in this case the duty ratio maintains at 80%, so the average of the output current (the dimming/average current shown in the figure) is 80% of the maximum current, i.e., the brightness of the light emitting device circuit 51 is about 80% the brightness when the duty ratio is 100%. The above are only examples for better understanding the dimming control. The maximum output current does not have to correspond to 100% of the duty ratio. Note that, in the prior art shown in FIG. 1, the power switch P is only capable of adjusting the output power, but not capable of adjusting the output current supplied to the light emitting device circuit 50.

Figure 6:
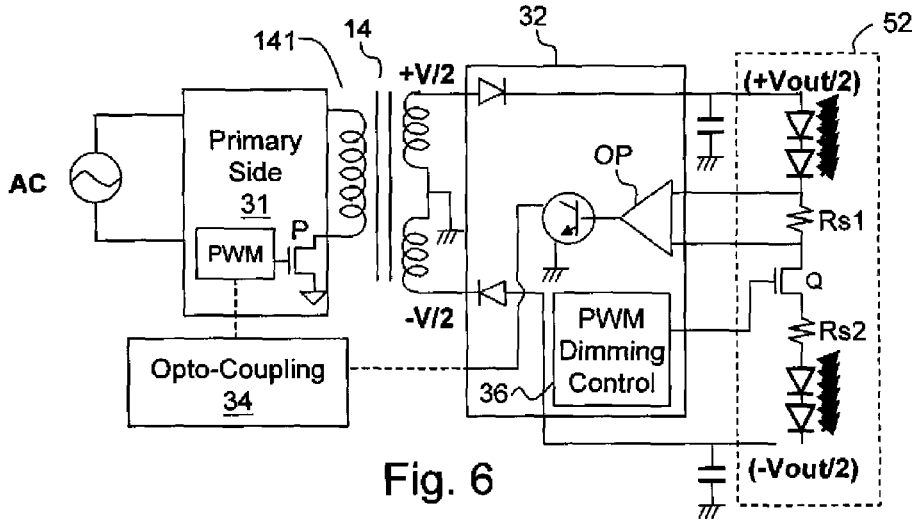
FIG. 6 shows another embodiment of the present invention.

FIG. 6 shows another embodiment of the present invention, which is different from the embodiment shown in FIG. 4 in that: in this embodiment, the secondary side circuit 32 further includes a PWM dimming control circuit 36, which outputs a dimming signal for controlling a transistor switch Q in a light emitting device circuit 52 to adjust the brightness of the light emitting device circuit 52. The brightness adjustment can be done in a similar way to that shown in FIGS. 5A and 5B. That is, assuming that 100% duty ratio of the transistor switch Q corresponds to maximum output current supplied to the light emitting device circuit 52, the PWM dimming control circuit 36 can adjust the duty ratio of the transistor switch Q, to correspondingly adjust the average of the output current, i.e., to control the brightness of the light emitting device circuit 52. As shown in FIG. 6, the transistor switch Q is located at about middle of the light emitting device string, i.e., there is at least one light emitting device connected to each of two sides of the transistor switch Q. In a preferred embodiment, the transistor switch Q are connected with resistors Rs1 and Rs2 at two sides respectively, such that each end of the transistor switch Q is connected with a resistor and half number of the light emitting devices, and coupled to the positive voltage +Vout/2 and a negative voltage −Vout/2 respectively through the resistors and the light emitting devices. As such, the transistor switch Q can operate around zero voltage. Either one of the resistors Rs1 and Rs2 can be used as a current detection device to detect the output current.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, the light emitting device circuit is not necessarily an LED circuit, but can be any other circuit which requires current control. As another example, the bipolar transistor in the secondary side circuit 32 can be substituted by a field effect transistor. As yet another example, a device which does not substantially influence the primary function of a signal can be inserted between any two devices in the shown embodiments, such as a switch or the like. All such variations and modifications should be interpreted as being included within the scope of the present invention.

What is claimed is:

1. A light emitting device driver circuit, comprising:

a primary side circuit for receiving AC power and generating a primary voltage;

a transformer coupled to the primary side circuit, the transformer including a primary winding and a secondary winding, for converting the primary voltage to a secondary voltage; and a secondary side circuit coupled to the transformer, the secondary side circuit generating an output voltage according to the secondary voltage, and providing an output current to a light emitting device circuit;

wherein the secondary winding has a first winding and a second winding, and the first and second windings provide a positive voltage and a negative voltage respectively, the positive and negative voltages together forming the secondary voltage, wherein the output voltage includes a positive output voltage and a negative output voltage, and the light emitting device circuit is coupled between the positive and negative output voltages, and wherein the secondary side circuit includes an operational amplifier which generates an operation signal according to a current detection signal related to the output current; and wherein the driver circuit further includes an opto-coupling circuit for generating a feedback signal according to the operation signal by opto-coupling, the feedback signal being fed back to the primary side circuit.

2. The driver circuit of claim 1, wherein the primary side circuit includes a power switch coupled to the primary winding, and a pulse width modulation (PWM) control circuit which switches the power switch according to the feedback signal to control the conduction time of the primary winding, to thereby adjust an average of the output current.

3. The driver circuit of claim 1, wherein the light emitting device circuit includes a current detection circuit for detecting the output current and generating the current detection signal.

4. The driver circuit of claim 3, wherein the light emitting device circuit includes at least one light emitting device string which has multiple light emitting devices connected in series, and the current detection circuit coupled in the light emitting device string, wherein there is at least one light emitting device located at each of two sides of the current detection circuit.

5. A light emitting device driver circuit, comprising:

a primary side circuit for receiving AC power and generating a primary voltage;

a transformer coupled to the primary side circuit, the transformer including a primary winding and a secondary winding, for converting the primary voltage to a secondary voltage; and a secondary side circuit coupled to the transformer, the secondary side circuit generating an output voltage according to the secondary voltage, and providing an output current to a light emitting device circuit;

wherein the secondary winding has a first winding and a second winding, and the first and second windings provide a positive voltage and negative voltage respectively, the positive and negative voltages together forming the secondary voltage, wherein the output voltage includes a positive output voltage and a negative output voltage, and the light emitting device circuit is coupled between the positive and negative output voltages, and wherein the light emitting device circuit includes at least one light emitting device string which has multiple light emitting devices connected in series, and a transistor switch coupled in the light emitting device string, wherein there is at least one light emitting device located at each of two sides of the transistor switch; and wherein the secondary side circuit includes a PWM dimming control circuit, which generates a dimming signal for controlling the transistor switch to adjust the average of the output current.

6. The driver circuit of claim 5, wherein the light emitting device circuit further includes two resistors which are coupled to the two sides of the transistor switch respectively.

7. A method for driving a light emitting device, comprising:

receiving AC power and generating a primary voltage according to the AC power;

providing a transformer having a primary winding and a secondary winding for converting the primary voltage to a secondary voltage, wherein the secondary voltage includes a positive voltage and a negative voltage;

converting the secondary voltage to a positive output voltage and a negative output voltage;

providing a light emitting device circuit coupled between the positive and negative output voltages;

detecting current through the light emitting device circuit; and feedback controlling the conduction time of the primary winding according to the detection result, wherein the light emitting device circuit includes at least one light emitting device string which has multiple light emitting devices connected in series, and a current detection circuit for detecting current through the light emitting device circuit, the current detection circuit being coupled in the light emitting device string, wherein there is at least one light emitting device located at each of two sides of the current detection circuit.

8. The method of claim 7, further comprising: controlling the conduction time of the primary winding by pulse width modulation, such that an average current through the light emitting device circuit is lower than a maximum current.

9. A method for driving a light emitting device, comprising:

receiving AC power and generating a primary voltage according to the AC power;

providing a transformer for converting the primary voltage to a secondary voltage, wherein the secondary voltage includes a positive voltage and a negative voltage;

converting the secondary voltage to a positive output voltage and a negative output voltage;

providing a light emitting device circuit coupled between the positive end negative output voltages; and controlling the conduction time of the light emitting device circuit by pulse width modulation, such that an average current through the light emitting device circuit is lower than a maximum current.

10. The method of claim 9, wherein the light emitting device circuit includes at least one light emitting device string which has multiple light emitting devices connected in series, and a transistor switch coupled in the light emitting device string, wherein there is at least one light emitting device located at each of two sides of the transistor switch; and the method further including: providing a PWM dimming control circuit, which generates a dimming signal for controlling the transistor switch to adjust the average of the output current.

11. The method of claim 10, wherein the light emitting device circuit further includes two resistors which are coupled to two sides of the transistor switch respectively.

* * * * *